US005813414A

United States Patent [19]

Zutler et al.

[11] Patent Number: 5,813,414

[45] Date of Patent: Sep. 29, 1998

[54] GOLF STAND

[75] Inventors: Michael Zutler, Woodbury; Robert Kipnes; John Klein, both of Jericho; Bruce Zutler, Port Washington; Aaron Zutler, Woodbury, all of N.Y.

[73] Assignee: MCI Products Group, Inc., Plainview, N.Y.

[21] Appl. No.: 786,322

[22] Filed: Jan. 23, 1997

[51] Int. Cl.[6] ..... A63B 55/04; A63B 55/10

[52] U.S. Cl. ..... 131/241; 473/282; 473/285; 473/286; 248/156

[58] Field of Search ..... 473/282, 285, 473/286, 216; 248/81, 76, 88, 156; 131/240.1, 241

[56] References Cited

U.S. PATENT DOCUMENTS

| | | | |
|---|---|---|---|
| 4,007,928 | 2/1977 | Doubt | 473/286 |
| 4,063,731 | 12/1977 | Kitay | 473/286 |
| 4,545,579 | 10/1985 | McCain | 473/282 |
| 5,116,046 | 5/1992 | Pace | 473/286 |

OTHER PUBLICATIONS

Advertisement from Magazine, p. 6, advertising product "Tee–Gar".

*Primary Examiner*—Sebastiano Passaniti
*Assistant Examiner*—Stephen L. Blau
*Attorney, Agent, or Firm*—Gottlieb, Rackman & Reisman, P.C.

[57] ABSTRACT

A stand assembly for use during golf is described. The stand assembly comprises a post having one end suitable for fixed insertion in the ground and a second end. The stand assembly also includes a support member that is designed and sized for selectively carrying a cigarette or cigar, or golf club grip.

10 Claims, 3 Drawing Sheets

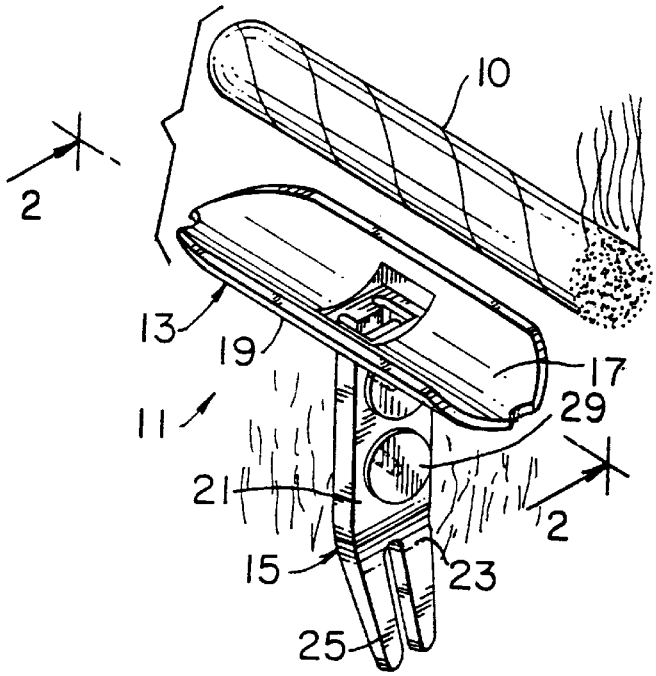
FIG. 1
FIG. 2
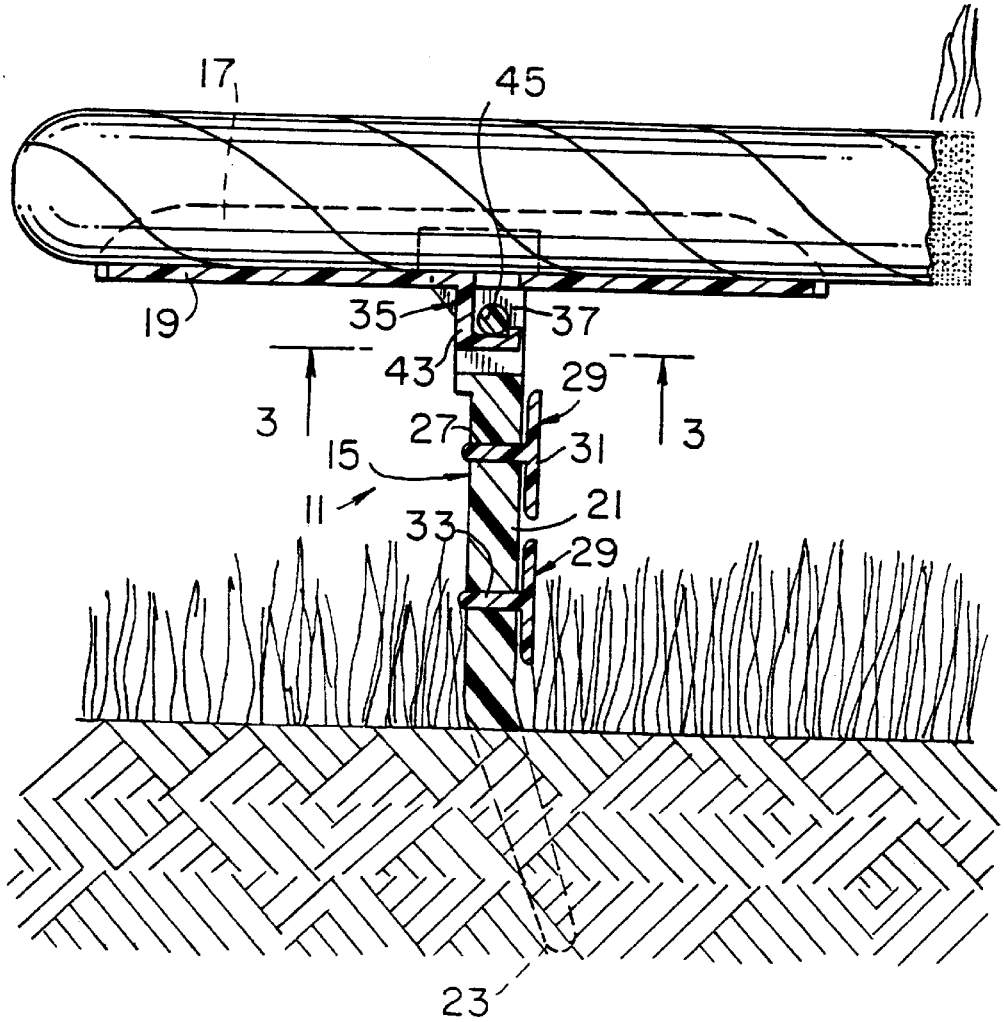

FIG. 3
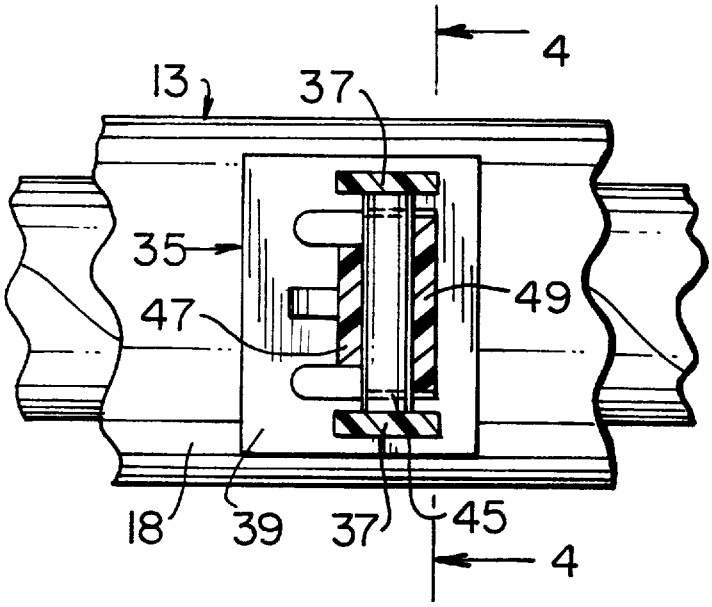
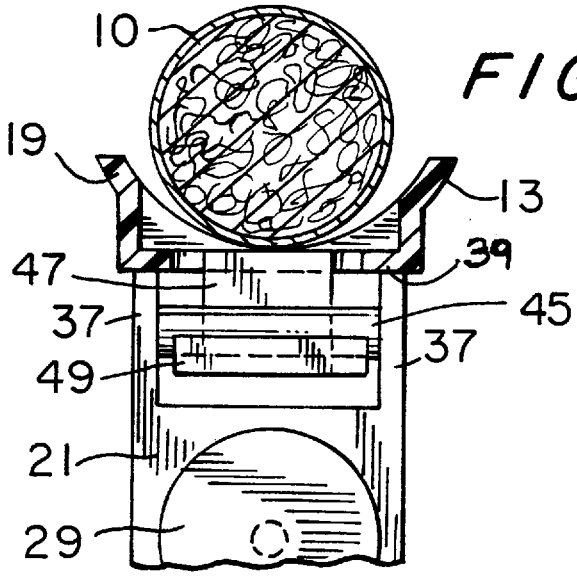
FIG. 4
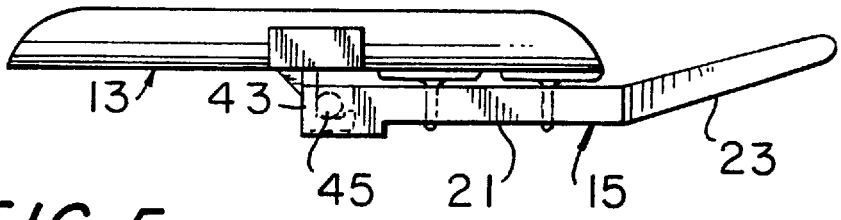
FIG. 5

GOLF STAND

BACKGROUND OF THE INVENTION

This invention relates to a cigar or cigarette stand that may be used during the sport of golfing, and particularly to a foldable stand for cigars and cigarettes which may also be used to support the handle grip of a golf club in order to keep it clean, dry and chemical free.

Golfing is an extremely popular sport in the United States and worldwide, and is played by numerous men and women, young and old alike. It is perhaps considered the consummate leisure sport.

Many individuals, while playing a "round" of golf, also desire to smoke a cigarette or cigar, which they find to be both pleasurable and part of the overall "leisure" attribute of the sport of golf. A problem, however, is what to do with a lit cigar or cigarette when the golfer is taking a golf swing or putt during a round of golf. If simply left in the golfer's mouth, it could interfere with his or her swing and concentration. Therefore, most golfers who smoke place the cigar or cigarette on the ground or grass. This is certainly less than desirable, as the grass or ground may be wet or dirty or may contain hazardous chemicals which can get on the cigar or cigarette.

Accordingly, it would be desirable to provide a mechanism for maintaining a lit cigar or cigarette off of the ground or grass while a golfer is taking a golf stroke.

SUMMARY OF THE INVENTION

Generally speaking, in accordance with the invention, a stand assembly for use during golf or other activities is described. The stand assembly comprises a post having one end suitable for fixed insertion in the ground and a second end. The stand assembly also includes a support member that is functionally designed and sized for selectively carrying a cigarette or cigar, or the grip of a golf club or other type of tool.

Significantly, the second end of the post is pivotally connected to the support member between its two ends. Thus, the support member can pivotally rotate from an operating position substantially perpendicular with respect to the post to a collapsed position substantially parallel to the post. The latter position facilitates storage in the golfer's pocket or golf bag. This position also facilitates use as a golfer's ball mark repair tool.

In addition, the support member can be pivotally disposed at an angle with respect to the post in order to carry thereon the handle of a golf club. Thus, when mounted on the ground, the inventive stand assembly can be used to keep the golf club handle off the grass or ground, ensuring that it will stay clean and dry.

Optionally, the end of the post, which is inserted in the ground during use of the inventive stand, may be constructed in the form of a divot or ball mark repair tool. Also, the post may carry one or more ball markers that may be needed by the golfer during on a putting green.

Accordingly, it is an object of the invention to design a golf stand assembly for carrying a cigar or cigarette off the ground.

Another object of the invention is to provide a stand assembly for keeping the handle of a golf club clean and off the ground.

A further object of the invention is to provide a golf stand assembly which is foldable for easy storage.

Still another object of the invention is any assembly for use as a golf tool.

Still other objects and advantages will in part be apparent and in part be obvious from the following description.

BRIEF DESCRIPTION OF THE DRAWINGS

For a more complete understanding of the invention, reference is made to the following description, taken in connection with the accompanying drawings, in which:

FIG. 1 is a perspective view of the stand assembly of the invention;

FIG. 2 is a cross-sectional view taken along line 2—2 of FIG. 1;

FIG. 3 is a cross-sectional view taken along line 3—3 of FIG. 2;

FIG. 4 is a cross-sectional view taken along line 4—4 of FIG. 3;

FIG. 5 is a front view illustrating the stand assembly in a folded condition;

DETAILED DESCRIPTION OF THE PREFERRED EMBODIMENT

Figure 6:
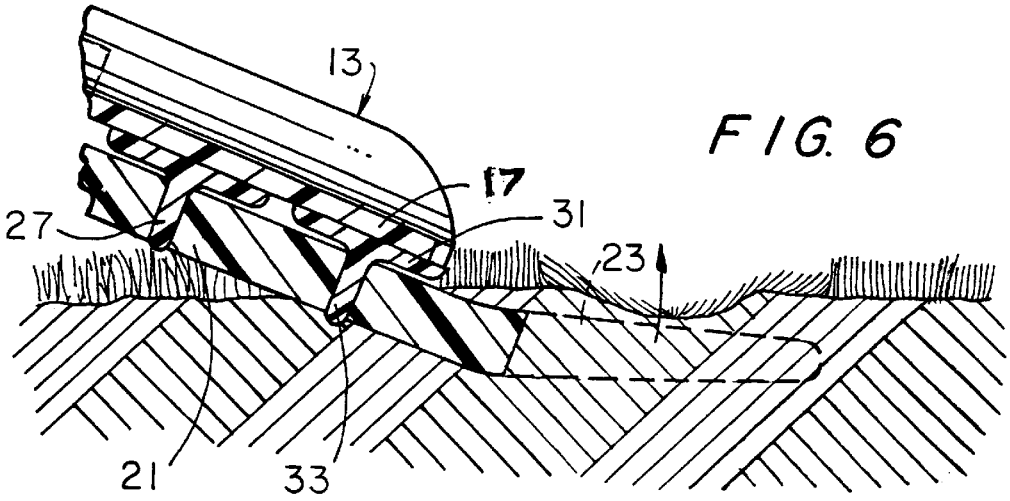
FIG. 6 is a side view in cross-section illustrating use of the divot/ball mark repair tool of the inventive stand assembly.

Referring first to FIGS. 1 and 2, the stand assembly of the invention, generally indicated at 11, is now described.

Assembly 11 comprises a post member 15 to which a support member 13 is pivotally connected. Post member 15 includes a straight first portion 21 and a second bent portion 23. Bent portion 23 includes a pair of forked teeth 25 for defining a divot/ball mark repair tool, the use of which will be described hereinafter. In an alternative embodiment, post member 15 is straight rather than bent. Post member 15 may, of course, not include teeth 25.

Support member 13 is substantially arcuate in configuration, and has a longitudinally extending concave support surface 17 on which a cigar or cigarette 10 may be carried. Surface 17 of support member 13 defines a rim 19 which helps prevent cigar 10 from accidentally falling off of member 13 once placed thereon. In an alternative embodiment, surface 17 of member 13 may be designed to also function as a divot/ball mark repair tool.

Referring now to FIGS. 2, 3, 4 and 5, pivot assembly 35 of stand assembly 15 is now described. Pivot assembly 35 includes a substantially rectangular support bracket 39 on underside 18 of support member 13. Bracket 39 is fixed to a pivot bracket 43 having an arm 47 depending downwardly from member 13. Arm 47 leads into a catch 49 adapted for pivoting about a pivot pin 45, as described below.

Pivot assembly 35 also includes a pair of upright brackets 37 depending from straight portion 21 of post member 15. As shown in FIGS. 3 and 4, pivot pin 45 is fixed between brackets 37 such that catch 49 of arm 47 can rotate about pin 45 as support member 13 is pivotally moved about post member 15. As a result, support member 13 can be rotated between a position substantially perpendicular to post 15 (see FIG. 2) to a condition substantially parallel to post 15 (FIG. 5) for easy storage in a golfer's pocket.

Figure 7:
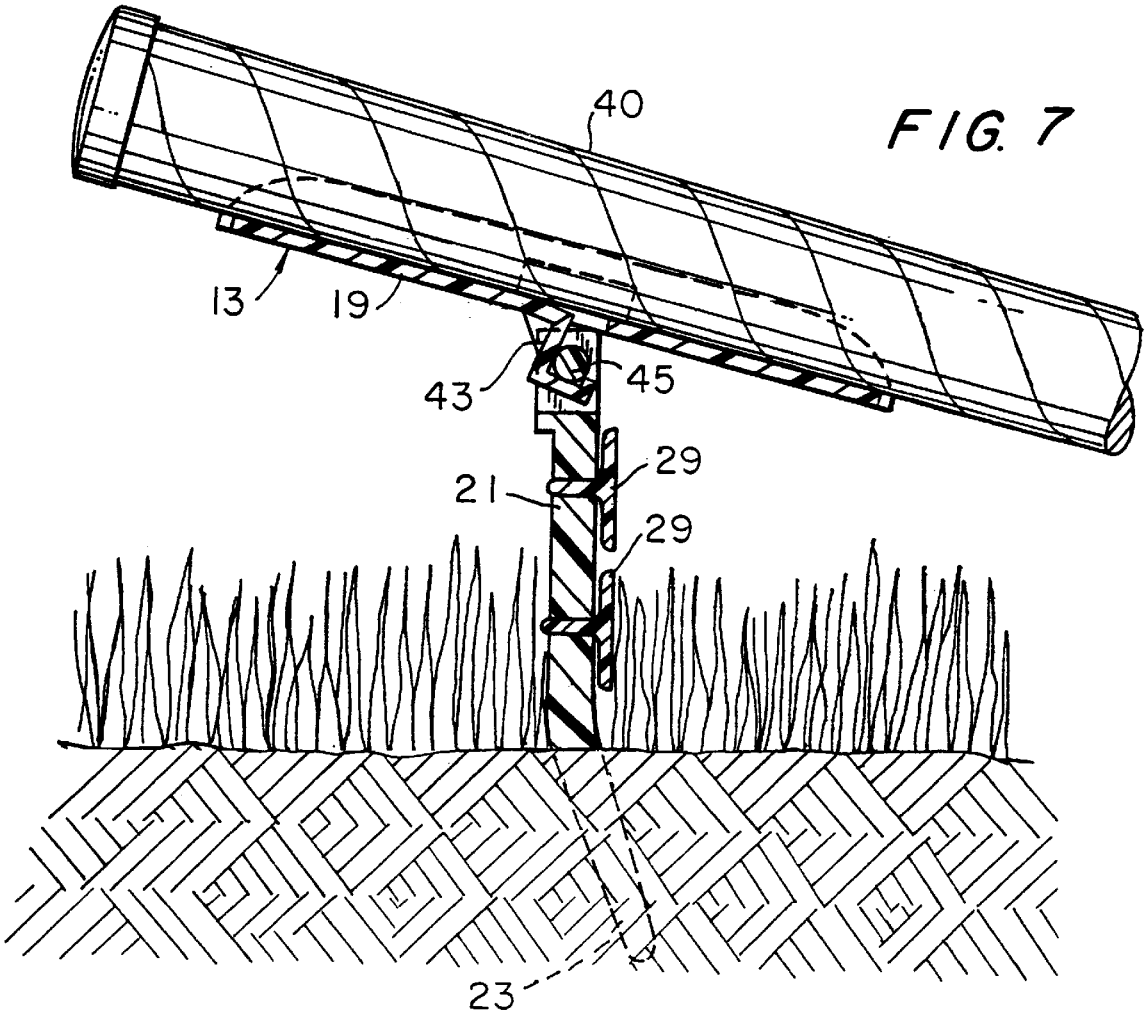
FIG. 7 is a side view in cross-section illustrating the grip of a golf club being supported by the inventive stand assembly.

Additionally, since catch 49 frictionally grips pin 45, support member 13 can be rotated to any desired angular position with respect to post member 15. For example, as shown in FIG. 7, support member 13 is shown positioned at an angle with respect to post member 15 in order to carry handle 40 of a conventional golf club. With this use of assembly 11, handle 40 remains dry and clean.

Alternatively, pivot assembly 35 may be designed to include a stop mechanism to prevent angular movement of post member 15 with respect to support member 13 for preventing reverse angular rotation.

Referring once again to FIGS. 1 and 2, and now also to FIG. 6, straight portion 21 of post member 15 may include a hole or holes 27 for carrying ball markers 29. Each ball marker 29 comprises a circular head 31 which rests flush against the front surface of straight portion 21 when carried by assembly 11 and a pin 33 sized for frictional reception within hole 27 as shown. Whenever one of ball markers 29 is needed to mark a golf ball on the green, it is removed from post member 15 as desired, and placed at the appropriate spot or location along the ground.

FIG. 6 also describes using bent portion 23 of post member 15 as a divot or ball mark repair tool. Assembly 11 is placed appropriately into the ground (in a folded condition for leverage purposes) such that bent portion 23 is inserted into the ground in order that teeth 25 are placed where a ball mark has been created in the ground, as shown. The user then applies some pressure to the upper portion of assembly 11, causing the ground to be massaged while at the same time repairing any ball mark in the ground.

Although a particular type of pivot mechanism of the inventive assembly is described, the invention is not limited to such a mechanism, and other such mechanisms may be used without departing from the design of the invention.

It will thus be seen that the objects set forth above, among those made apparent from the preceding description, are efficiently obtained and, since certain changes may be made in the above process, and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover the generic and specific features of the invention herein described, and all statements of the scope of the invention which, as a matter of language, might be said to fall therebetween.

What is claimed is:

1. A stand assembly comprising:

a post member having a first end for selective reception in the ground and a second end;

a support member having first and second ends;

wherein said second end of said post member is pivotally connected to said support member between said support member's first and second ends such that said support member can pivotally rotate to a plurality of positions between a first position substantially perpendicular with respect to said post member and a second collapsed position substantially parallel to said post member;

wherein said pivotal connection includes a pivot bracket fixed to said support means and pivotally rotatable about a pivot pin fixed to said post member at its second end.

2. The assembly of claim 1, wherein said first end of said post member includes a divot or ball mark golf repair tool.

3. The assembly of claim 1, wherein said pivot bracket includes an arm for selectively rotating about said pivot pin.

4. The assembly of claim 1, wherein said pivot pin is fixed to said post member by at least one upright bracket depending from said first end of said post member.

5. The assembly of claim 1, wherein said post member includes means for selectively carrying at least one golf ball marker.

6. The assembly of claim 5, wherein said carrying means comprises a hole formed in said post member.

7. A stand assembly for a golf club having a grip comprising:

a post member having a first end for selective insertion in the ground and a second end;

a support member defining an arcuate shaped longitudinally extending cradle portion sufficiently sized for freely and removably carrying a portion of the said grip of said golf club without any frictional interface between said grip and said support member in order to prevent said grip from contacting the ground;

wherein said second end of said post member is pivotally connected to said support member such that said support member can pivotally rotate between a first position substantially perpendicular with respect to said post member and a second collapsed position substantially parallel to said post member.

8. The assembly of claim 7, wherein said support member is sized for carrying and supporting a cigarette or cigar.

9. The assembly of claim 7, wherein said support member includes longitudinally extending rim edges.

10. The assembly of claim 7, wherein said support member can pivotally rotate to a plurality of positions between said first and second positions.

* * * * *